US005630634A

United States Patent [19]

Stowe et al.

[11] Patent Number: 5,630,634

[45] Date of Patent: May 20, 1997

[54] DEVICE FOR MAGNETICALLY ENGAGING OBJECTS HAVING VARIABLE SURFACE CONTOURS

[75] Inventors: Michael W. Stowe, P.O. Box 402, Boyne City, Mich. 49712; Claire T. Martin, Charlevoix, Mich.

[73] Assignee: Michael W. Stowe, Boyne City, Mich.

[21] Appl. No.: 639,247

[22] Filed: Apr. 23, 1996

Related U.S. Application Data

[63] Continuation of Ser. No. 364,376, Dec. 27, 1994, abandoned.

[51] Int. Cl.[6] ..... B66C 1/06; H01F 7/20

[52] U.S. Cl. ..... 294/65.5; 335/291

[58] Field of Search ..... 294/65.5; 335/285, 335/289, 291, 294, 295, 298

[56] References Cited

U.S. PATENT DOCUMENTS

| | | | |
|---|---|---|---|
| 777,221 | 12/1904 | Piek | 335/291 |
| 3,078,565 | 2/1963 | Sanders | 29/529 |
| 3,363,209 | 1/1968 | Pevar | 335/286 |
| 3,798,581 | 3/1974 | Anderson et al. | 335/291 |
| 4,652,845 | 3/1987 | Finkle | 294/65.5 X |
| 4,840,417 | 6/1989 | Izumi et al. | 294/65.5 |
| 4,893,858 | 1/1990 | Yoshitani et al. | 294/65.5 |

FOREIGN PATENT DOCUMENTS

| | | | |
|---|---|---|---|
| 469833 | 8/1914 | France | 335/291 |
| 1496195 | 9/1967 | France | 335/291 |
| 3228178 | 2/1984 | Germany | 294/65.5 |

*Primary Examiner*—Johnny D. Cherry
*Attorney, Agent, or Firm*—Young & Basile, P.C.

[57] ABSTRACT

The specification discloses a magnetizable device for engaging articles of varying surface contours. The device is characterized by a number of independently movable magnetizable elements which depend from a slot in the device housing; the elements being retained by element-arresting projections extending from each element's upper-most end. In one embodiment, the slot of the present invention is a bobbin assembly, including first and second halves which join to define a substantially rectangular slot.

21 Claims, 3 Drawing Sheets

DEVICE FOR MAGNETICALLY ENGAGING OBJECTS HAVING VARIABLE SURFACE CONTOURS

This application is a continuation of application Ser. No. 08/364,376 filed on Dec. 27, 1994, now abandoned.

FIELD OF THE INVENTION

The present invention relates to a magnetizable device designed to conform to variable surface contours such that engagement between the surface contours and the device are maximized. Specifically, this invention relates to a device having a plurality of independently movable, magnetizable elements capable of varying degrees of extension from a housing, such that the extension of each such element corresponds to the adjacent portion of an object's surface contour.

BACKGROUND OF THE INVENTION

Prior art contour-conforming magnetic devices are well-known. One known commercial use for such devices is the lifting of heavy, irregularly-shaped, magnetizable objects. Pevar, U.S. Pat. No. 3,363,209, describes such a device as including a plurality of adjacent, magnetizable plates. By means of a pair of rods passing through vertically extending holes in the body of each plate, the plates are connected to a housing.

In contrast, Izumi et al., U.S. Pat. No. 4,840,417, discloses an alternative, entirely magnetic coupling between the magnetizable elements and the device housing.

Both of these devices suffer from drawbacks, however. The Pevar device does not provide a wide range of vertical movement for the plates, thus limiting the variety of engageable contours. Relatedly, Izumi fails to teach a device having the security of mechanical engagement between the magnetizable elements and the device housing. The device of Izumi is further plagued by slippage. When the application is lifting objects, a sufficiently heavy object may overcome the magnetic attraction between the housing and the magnetizable elements. As a result, both the object and the magnetizable elements fall away from the housing.

SUMMARY OF THE INVENTION

An object of the present invention is, therefore, to provide for a contour-conforming, magnetizable device capable of engaging a wide variety of contoured surfaces.

A second object of the present invention is to provide such a contour-conforming device with a secure, mechanical attachment between the magnetizable elements and the housing without substantially impairing the contour-conforming capabilities of the device.

All of the objects of the present invention may be attained by a contour-conforming, magnetizable device including a plurality of magnetizable elements mechanically secured to the device housing. In particular, the device housing includes at least one slot with which the plurality of magnetizable elements are slidingly engaged. At one end of each of said magnetizable elements are disposed outwardly protruding, element-arresting projections which releasingly engage an upper edge of the slot, insuring the retention of each element within the housing.

The slot itself includes a bobbin assembly, having first and second spaced, parallel sides defining an opening therebetween. The upper, distal ends of both the first and second sides are characterized by outwardly projecting flanges.

Each flange is oriented perpendicularly with respect to each of the first and second sides. In one embodiment of the present invention, the bottom distal ends of each of the first and second sides also include similar perpendicularly oriented flanges, such that the bobbin assembly has an "T" shaped cross-section. In another embodiment, the bobbin assembly is characterized by two separate halves. Each half includes two spaced, parallel flanges extending from one of either the first or second sides. Both the first and second sides of each half are further characterized by "L" shaped surfaces having reversed spatial orientation with respect to each other. By virtue of this arrangement, the joinder of both halves defines a substantially rectangular slot therebetween.

DESCRIPTION OF THE ILLUSTRATED EMBODIMENT

Figure 1:
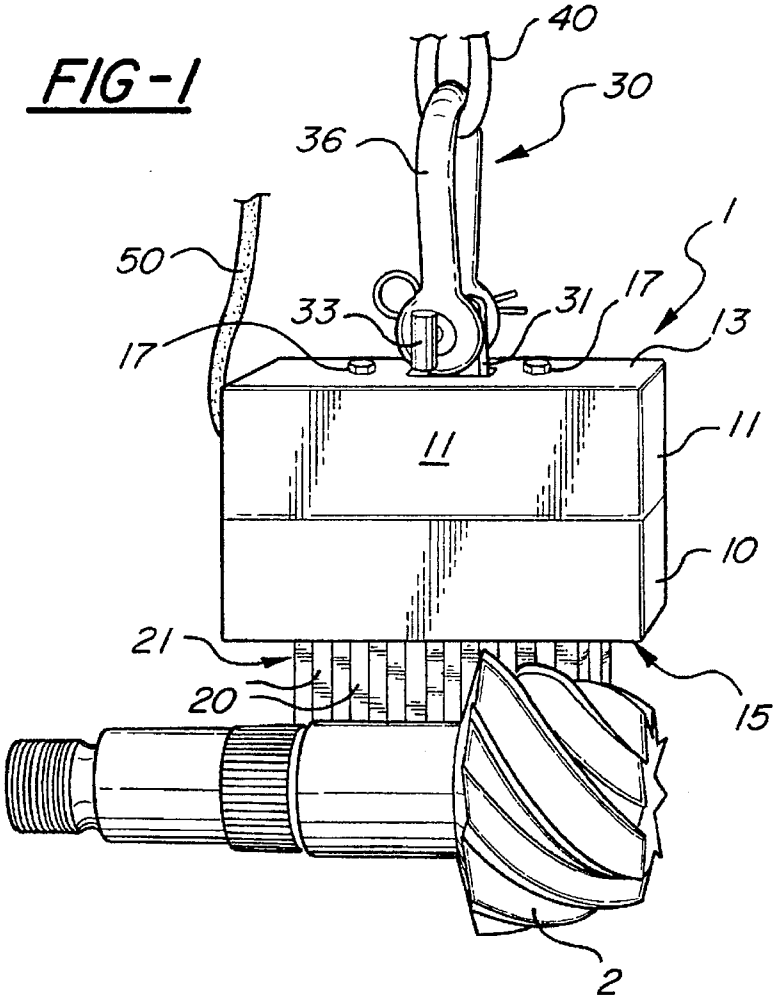
FIG. 1 is a side elevation of the present invention shown engaging an object with a contoured surface.

Referring to FIG. 1, the device of the present invention is shown. As illustrated the device 1 includes a housing 10 of welded steel construction, a number of magnetizable elements 20 arranged in two spaced, parallel rows 21, a support structure 30, and a power supply cable 50. Housing 10 is essentially box-shaped, including four sides 11, a cover section 13, and a bottom section 15. Cover section 13 is removable, being fastened to the body (not shown) of the device by a pair of bolts 17. Bottom section 15, as illustrated, includes a pair of spaced, parallel slots (not shown) through which a portion of elements 20 protrude. Support structure 30 includes an anchor member 31 to which is pivotally engaged a "U"-shaped bracket 36. Such support structures are well-known and can be designed in a variety of ways. In the illustrated embodiment, the bracket 36 is fastened to anchor 31 by means of a cotter pin 33. A cable 40, made of chain, rope, or the like, is fastened at one end thereof to bracket 36. As shown, the cable is threaded through the bracket, being attached at its opposite end to a ceiling-mounted hoist mechanism, such as are well-known in the art.

Figure 2:
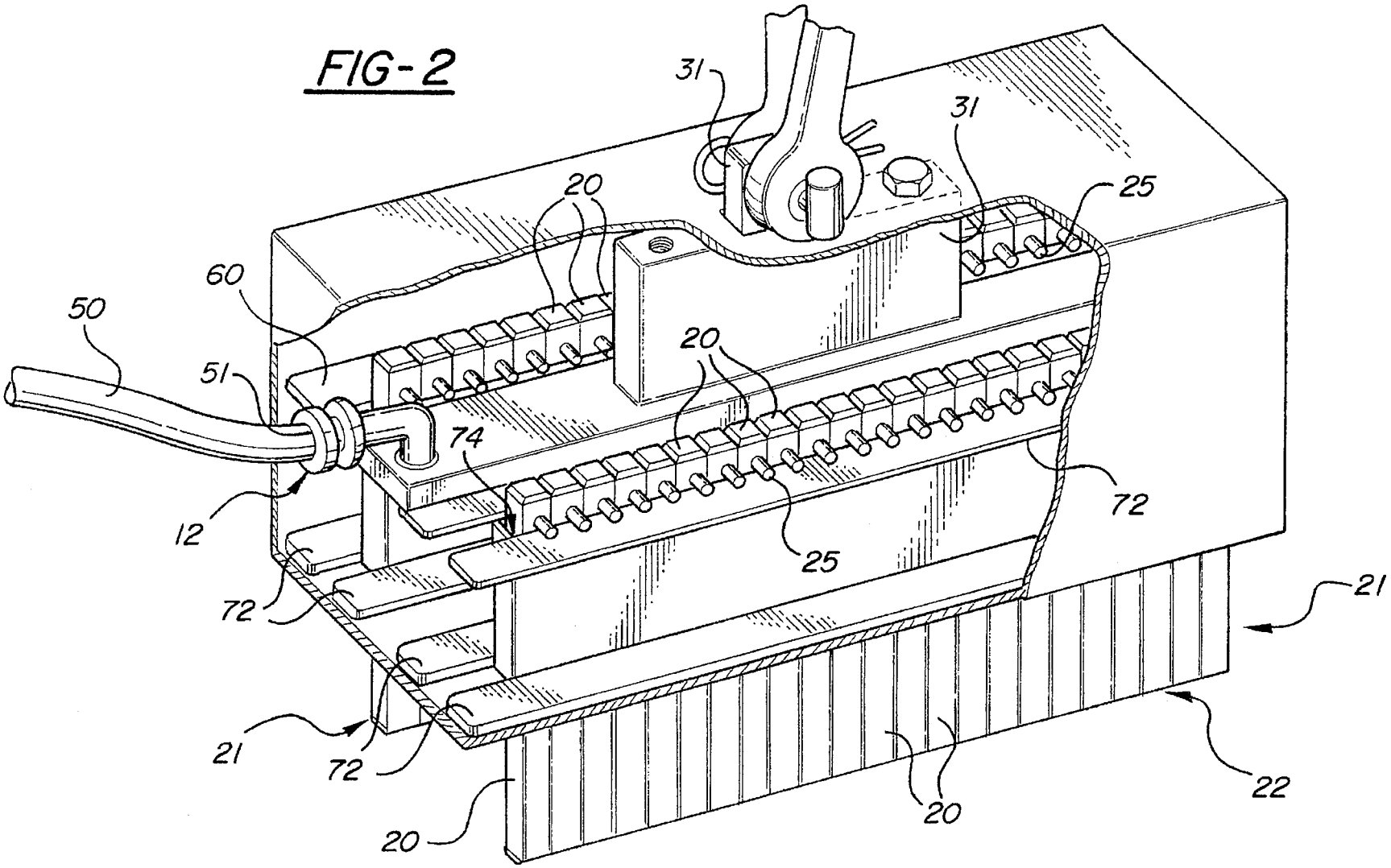
FIG. 2 is a perspective, cut-away view of the present invention.

As shown in FIG. 2, the interior of device 1 includes a pair of bobbin assemblies 70, an electrically conductive core element 60, and the unexposed remainder of anchor member 31. Bobbin assemblies 70 define opposing, parallel slots 74, with which magnetizable elements 20 are slidingly engaged. Electrically conductive core element 60, which is connected to power supply cable 50 at one end thereof, is in electrical communication along its long axis with the upper surfaces of both bobbin assemblies. In the illustrated embodiment, this electrical communication is accomplished by welding core element 60 to an upper surface of each bobbin assembly. In this manner, the conductive core element is capable of providing a suitable current field to each opposing array of magnetizable elements 21. It can also be seen from FIG. 2 that power supply cable 50 extends through a hole 12 in one side of the device housing 10. A cylindrical stress-relief guide 51 surrounds cable 50 at this juncture, providing sealing engagement between the cable and the wall of the housing. As illustrated, stress-relief guide 51 is made of rubber or a similarly flexible polymeric material. This serves to prevent the side of metal housing 10 from wearing away the insulating coating of power supply cable 50 during operation, when the cable is subject to torsional strain.

Figure 4:
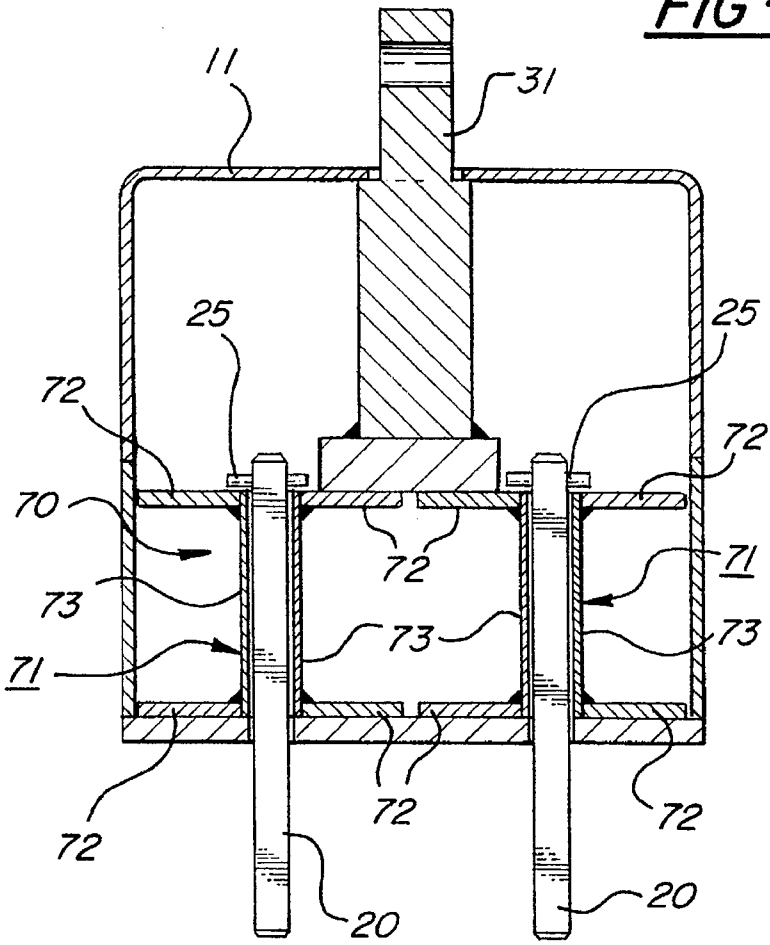
FIG. 4 shows a frontal cross-section of the bobbin assembly of the present invention, including a lateral view of one magnetizable element.

FIGS. 2 and 4 illustrate the parallel arrangement of each array of magnetizable elements 21. As shown, a number of elements 20 are vertically disposed in each slot 74, each element in the array being parallel with respect to every other element. Adjacent elements are in sliding contact with each other along adjacent vertical surfaces. In addition, those vertical surfaces not in contact with the adjacent surfaces of adjacent elements are in sliding contact with the opposing interior surfaces of the vertical plates 73 of each bobbin assembly 70. The upper end of each element is further characterized by rod-like element-arresting projections which extend away from opposing vertical sides of each element. In the illustrated embodiment, each element includes a cylindrical bore through its upper end. Element-arresting projection 25, constructed from a single piece of metal, such as a steel alloy or the like, is securely engaged through the cylindrical bore such that equal lengths of the projection protrude from either side of the bore. Of course, alternative embodiments can include pins which are formed integral to the elements.

As shown most clearly in FIG. 4, element-arresting projection 25 extends a sufficient distance to either side of each element so as to engage the upper surface 72 of each bobbin assembly when the elements are in their fully extended position. For this reason, it is preferable that element-arresting projections 25 be constructed of a suitably strong material, such as steel.

Figure 3:
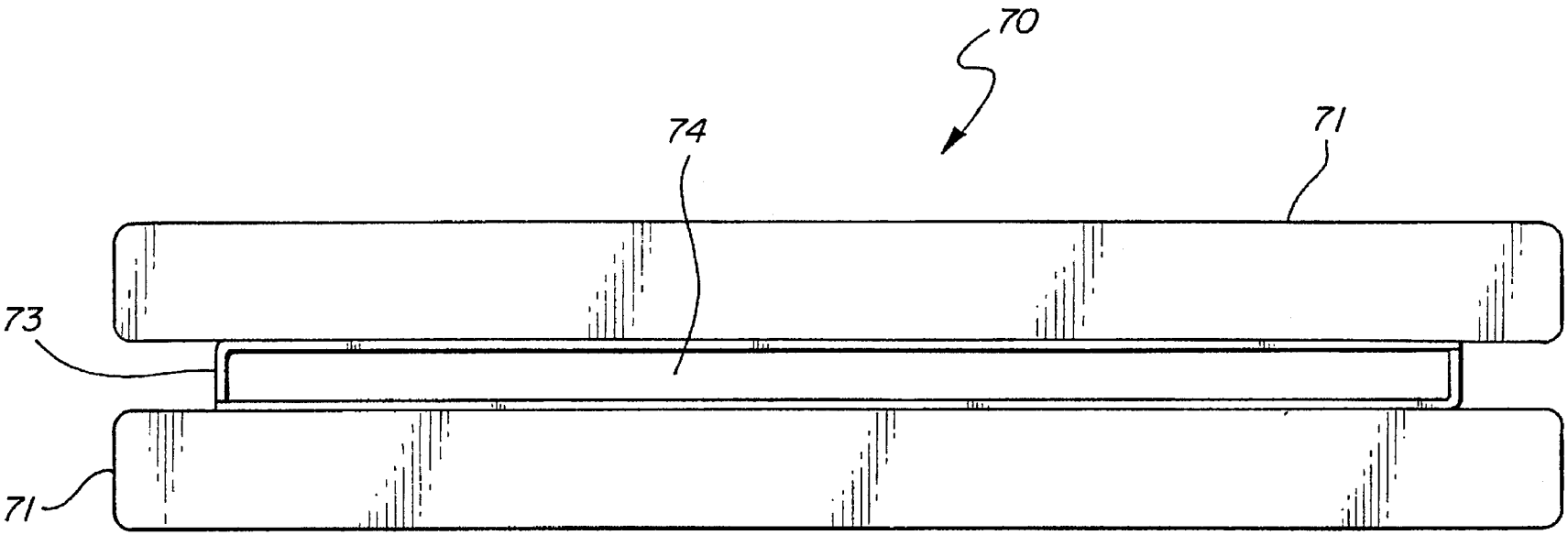
FIG. 3 illustrates a top-down view of the bobbin assembly of the present invention.

Referring now to FIGS. 3 and 4 together, details of the bobbin assembly are illustrated. The illustrated bobbin assemblies 70 each have an essentially "I"-shaped cross-section defined by two opposing halves 71. Each half includes two spaced, substantially parallel horizontal plates 72 extending away from a central, vertically disposed plate 73. Each horizontal plate is primarily rectangular, having a length roughly equivalent to the length of the interior of device housing 10. Each central plate 73 is somewhat shorter in length and is characterized by an "L" shape. As shown, the central plates of opposing halves of each bobbin member have reversed spatial orientations, such that, when joined, both central plates define a walled slot 74 having a substantially rectangular shape. In the illustrated embodiment, opposing bobbin halves are fixedly joined by welding or a similar, commonly known technique for bonding metal components.

The vertical height of each bobbin assembly is dictated by the length of the elements 20. In order to ensure maximum extension of each element, the bobbin assemblies should not have too great a vertical height. This is offset, however, by the need to retain a sufficient length of each element within the device housing so as to prevent shearing of the elements 20 during operation. In the illustrated embodiment, each bobbin assembly is equal in height to approximately half the overall height of the device, while each element has a vertical length such that a fully retracted element just fits within the device housing.

Referring again to FIG. 1, the device of the present invention is shown in operation. As illustrated, the device is suspended by a cable 40, or other suitable suspending means attached to the bracket 36 of support structure 30. A winch or other hoisting apparatus (not shown) is attached to the opposite free end of the cable. In one embodiment, the winch may be also attached to a ceiling mounted track (not shown) such that the device may be moved from one point to another. Ceiling-mounted tracks of this kind are well known in the art. At some region along the length of the power supply cable 50 is disposed a current selector switch (not shown), enabling current to be selectively supplied to the device 1. Such current selector switches are well-known to those familiar with this art.

While no current is being supplied to it via the power supply cable, the device 1 is hoisted into position over a magnetizable object, such as the ferrous gear 2 depicted. Lacking a current field, the arrays of magnetizable elements will be fully extended, depending freely from the upper surfaces of each bobbin assembly 70 (FIGS. 3 and 4). As the device is lowered over the object 2, a number of the magnetizable elements will be forced upwards into the housing; the distance of their movement corresponding to the surface contours of the object. When the contour engaging surface 22 of each element is in contact with a portion of the object, current is supplied to the device. The core (not shown) provides a current field through the vertical plates of each bobbin assembly, magnetizing the bobbin assembly, the elements, and the object. The magnetic field at the interface between each bobbin assembly's vertical plates and the elements will fix the positions of the elements 20, while the magnetic field between the elements 20 and the object 2 will keep the object secure for lifting. As will be appreciated, the current field must be sufficient to correspond to the weight of the object being lifted.

Of course, it is understood that the foregoing is merely an illustrated embodiment of the invention. Various other changes and alterations, apparent to those skilled in the art, can be made without departing from the spirit and broader aspects thereof as set forth in the appended claims.

The embodiments in which an exclusive property or privilege is claimed are defined as follows:

1. A device for engaging articles of varying surface contours, comprising:

a plurality of independently positionable magnetically-conductive elements;

a bobbin assembly having at least a first pair of plates fixedly connected in parallel-opposed fashion to define a walled slot therebetween for slidingly receiving said magnetically-conductive elements, each of said at least first pair of plates having upper and lower surfaces;

a selectively magnetizable core member for selectively magnetizing said plurality of magnetically-conductive elements;

each one of said plurality of magnetically-conductive elements including at least one element-arresting projection extending therefrom and opposing said upper surfaces of at least one of said first pair of plates; and wherein said upper surfaces of said plates each comprise a plate extending approximately perpendicularly away therefrom.

2. The device of claim 1, wherein said at least first pair of plates each define essentially 'L'-shaped members reversed in spatial orientation with respect to each other such that in said fixed connection said "L"-shaped members define said walled slot.

3. The device of claim 2, wherein said lower surfaces of each of said at least first pair of plates each comprise a plate extending away from therefrom, such that said bobbin assembly is characterized by an "I"-shaped transverse cross-section.

4. The device of claim 1, wherein said bobbin assembly is disposed within a housing comprising a box having first and second pairs of opposing sides, a cover surface, and a bottom surface, said bottom surface including an opening sufficient for receiving therethrough said plurality of magnetically-conductive elements.

5. The device of claim 1, wherein said magnetically-conductive elements are characterized by an elongate shape having an upper end, each said element further including at least first and second vertically coextensive surfaces, and a contour-engaging surface.

6. The device of claim 5, said element-arresting projection extends outwardly from said first and said second surfaces of each magnetically-conductive element.

7. The device of claim 6, said element-arresting projections further located at the upper end of each of said elements.

8. The device of claim 5, wherein each of said magnetically-conductive elements is further characterized by a bore extending through the upper end of each said magnetically-conductive elements between said at least first and second vertically coextensive surfaces.

9. The device of claim 8, wherein said at least one element-arresting projection comprises an essentially rod-shaped member which extends through said bore such that a portion of said rod-shaped member protrudes from either side of said bore.

10. The device of claim 9, wherein said magnetically-conductive elements further include third and fourth vertically coextensive surfaces, said magnetically-conductive elements being characterized by an essentially square transverse cross-section.

11. The device of claim 1, in which said housing comprises an essentially box-shape, having first and second pairs of opposing sides, a cover surface, and a bottom surface, said bottom surface further including at least one hole therethrough for receiving said plurality of magnetically-conductive elements.

12. In a device for engaging articles of varying surface contours, said device including a plurality of independently movable, magnetically-conductive elements, the improvement comprising:

an essentially "T" shaped bobbin assembly including a first pair of opposing, vertically oriented plates having upper and lower surfaces and defining a walled slot therebetween, and at least one plate extending approximately perpendicularly from each of said upper and lower surfaces of said vertically oriented plates;

each one of said plurality of magnetically-conductive elements being slidingly received within said at least one walled slot;

wherein said bobbin assembly further comprises distinct halves; and wherein said vertically oriented plates each define essentially "L" shaped members disposed in reversed spatial orientation with respect to each other to define said walled slot; and wherein said housing comprises a box having first and second pairs of opposing sides, a cover surface, and a bottom surface, said bottom surface further including at least one opening for receiving therethrough said plurality of magnetically-conductive elements.

13. A device for engaging articles of varying surface contours, comprising:

a plurality of independently moveable magnetically-conductive elements;

at least one bobbin assembly comprising at least first and second vertically-oriented plates fixedly connected to each other in parallel-opposed fashion to define a walled slot for slidingly receiving said magnetically-conductive elements therein in a linear relationship and having upper and lower surfaces, said bobbin assembly further including at least one plate extending approximately perpendicularly away from each side of said walled slot, at least one of said vertically-oriented plates proximate each of said upper and lower surfaces such that said bobbin assembly is characterized by a generally "T" shaded transverse cross- section;

means for selectively magnetizing said magnetizing said magnetically-conductive elements.

14. The device of claim 13, wherein each of said magnetically-conductive elements includes at least one element-arresting projection protruding therefrom, said element-arresting projection opposed to said at least one plate of said bobbin assembly.

15. A device for engaging articles of varying surface contours, comprising:

at least one bobbin assembly having a walled slot for slidingly receiving therein a plurality of independently moveable magnetically-conductive elements, said walled slot including upper and lower surfaces, said bobbin assembly further including at least one plate extending away from each side of said walled slot, at least one of said plates proximate each of said upper and lower surfaces; and means for selectively magnetizing said magnetically-conductive elements.

16. The device of claim 15, wherein said walled slot comprises at least a first pair of plates fixedly connected in substantially parallel-opposed fashion.

17. The device of claim 16, wherein said walled slot is substantially rectangular in dimensions, each of said at least first pair of plates defining an essentially "L" shaped member.

18. The device of claim 17, wherein said plates extending away from each side of said walled slot each extend approximately perpendicularly from one of said upper or lower surfaces, such that said bobbin assembly is characterized by an essentially "T" shaped cross-section.

19. The device of claim 18, wherein each of said plates extending away from each side of said walled slot are further at least coextensive along one edge thereof with the adjacent surface of said walled slot.

20. The device of claim 15, wherein each of said magnetically-conductive elements further includes an element arresting projection extending therefrom.

21. The device of claim 15, wherein said means for selectively magnetizing said magnetically-conductive elements comprise a selectively magnetizable core member.

* * * * *